US008020412B2

(12) United States Patent
Kim et al.

(10) Patent No.: US 8,020,412 B2
(45) Date of Patent: Sep. 20, 2011

(54) WASHING MACHINE WITH ODOR REMOVAL FUNCTION

(75) Inventors: Kyeong Hwan Kim, Seoul (KR); Soo Young Oh, Seoul (KR); Myong-Hun Im, Gwangmyeong (KR); Kyung-Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 447 days.

(21) Appl. No.: 11/715,400

(22) Filed: Mar. 8, 2007

(65) Prior Publication Data

US 2008/0078210 A1 Apr. 3, 2008

(30) Foreign Application Priority Data

Oct. 2, 2006 (KR) ..... 10-2006-0097448

(51) Int. Cl.
*B08B 3/12* (2006.01)
*D06F 37/00* (2006.01)

(52) U.S. Cl. ..... 68/3 R; 68/19.1; 68/19.2; 68/20; 251/209; 251/318; 34/595; 34/596

(58) Field of Classification Search ..... None
See application file for complete search history.

(56) References Cited

U.S. PATENT DOCUMENTS

| | | | | |
|---|---|---|---|---|
| 1,714,223 | A | 5/1929 | Hondeville | |
| 3,435,850 | A * | 4/1969 | Male | 137/625.34 |
| 2003/0066206 | A1 * | 4/2003 | Woo et al. | 34/425 |
| 2005/0028564 | A1 * | 2/2005 | Lee et al. | 68/24 |
| 2005/0262644 | A1 * | 12/2005 | Oak et al. | 8/158 |
| 2006/0005585 | A1 * | 1/2006 | Lee et al. | 68/142 |
| 2006/0117808 | A1 * | 6/2006 | Oh et al. | 68/3 R |

FOREIGN PATENT DOCUMENTS

| | | | |
|---|---|---|---|
| EP | 1602766 | A | 12/2005 |
| EP | 1605091 | A | 12/2005 |

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

A washing machine with an odor removal function includes a cabinet, a tub received in the cabinet and including an intake port and an exhaust port so as to receive and discharge air, and a washing tub rotatably provided in the tub. Here, ambient air flows into the tub through the intake port by a suction force generated when the washing tub rotates and air inside the washing tub flows to the outside, such that odor of laundry is removed. Therefore, a washing machine with an odor removal function capable of easily and quickly removing laundry odor is provided.

14 Claims, 8 Drawing Sheets

WASHING MACHINE WITH ODOR REMOVAL FUNCTION

This application claims the benefit of Korean Application No. 10-2006-0097448, filed on Oct. 2, 2006, which is hereby incorporated by reference for all purposes as if fully set forth herein.

BACKGROUND OF THE INVENTION

1. Field of the Invention

The present invention relates to a washing machine with an odor removal function, and more particularly, to a washing machine with an odor removal function that may remove the smell of laundry by contacting the laundry with outside air.

2. Discussion of the Related Art

In general, a washing machine includes a tub that accommodates water therein and a washing tub that is rotatably provided inside the tub. The washing machine receives laundry in the washing tub, and water and detergent in the tub so as to remove the dirt of the laundry by the operation of the water and the detergent.

As shown in FIG. 1, a washing machine includes a cabinet 11, a tub 21 in the cabinet 11, and a washing tub 31 that is rotatably provided in the tub 21.

An opening 12 and a door 13 are provided on a front surface of the cabinet 11 such that the laundry can be put in and taken out of the washing tub. In the cabinet 11, the tub 21 is supported by a spring 22 and a damper 23.

The tub 21 has a cylindrical shape with one side thereof open. The washing tub 31 is rotatably provided in the tub 21. The washing tub 31 has a cylindrical shape with one side thereof open. Further, a plurality of through holes 33 are formed on a circumferential surface of the washing tub 31. A plurality of lifts 35 are provided in the washing tub 32 so as to lift the laundry.

Meanwhile, a driving motor 25 is coupled to a rear end portion of the tub 21 so as to rotate the washing tub 31. A drain path 27 that includes a drain pump 28 is provided at a lower part of the tub 21 so as to drain water.

A detergent dispenser 41 is provided above the tub 21 so as to supply detergent. A water supply pipe 43 is connected to the detergent dispenser 41. A water supply valve 45 is provided on the water supply pipe 43.

However, in the washing machine according to the related art, wash, rinse, and/or spin drying is performed according to a selected operating mode. Even after the odor of the laundry is removed, the laundry continues to be washed using water. Therefore, water and power are wasted and the lifespan of the laundry is shortened, as compared to washing just until the odor of the laundry is removed.

SUMMARY OF THE INVENTION

Accordingly, the present invention is directed to a washing machine with an odor removal function that substantially obviates one or more of the problems due to limitations and disadvantages of the related art.

An advantage of the present invention is to provide a washing machine with an odor removal function capable of quickly and easily removing the smell of laundry odor.

Another advantage of the present invention is to provide a washing machine with an odor removal function that prevents shortening of the lifespan of laundry that is caused by excessive and unnecessary washing and decreases the amount of water consumed for deodorization.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided a washing machine with an odor removal function that includes a cabinet, a tub received in the cabinet and including an intake port and an exhaust port so as to receive and discharge air, and a washing tub rotatably provided in the tub. Here, ambient air flows into the tub through the intake port by a suction force generated when the washing tub rotates and air inside the washing tub flows to the outside, such that laundry odor is removed.

It is to be understood that both the foregoing general description and the following detailed description are exemplary and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the embodiments of the present invention, examples of which are illustrated in the accompanying drawings.

Figure 1:
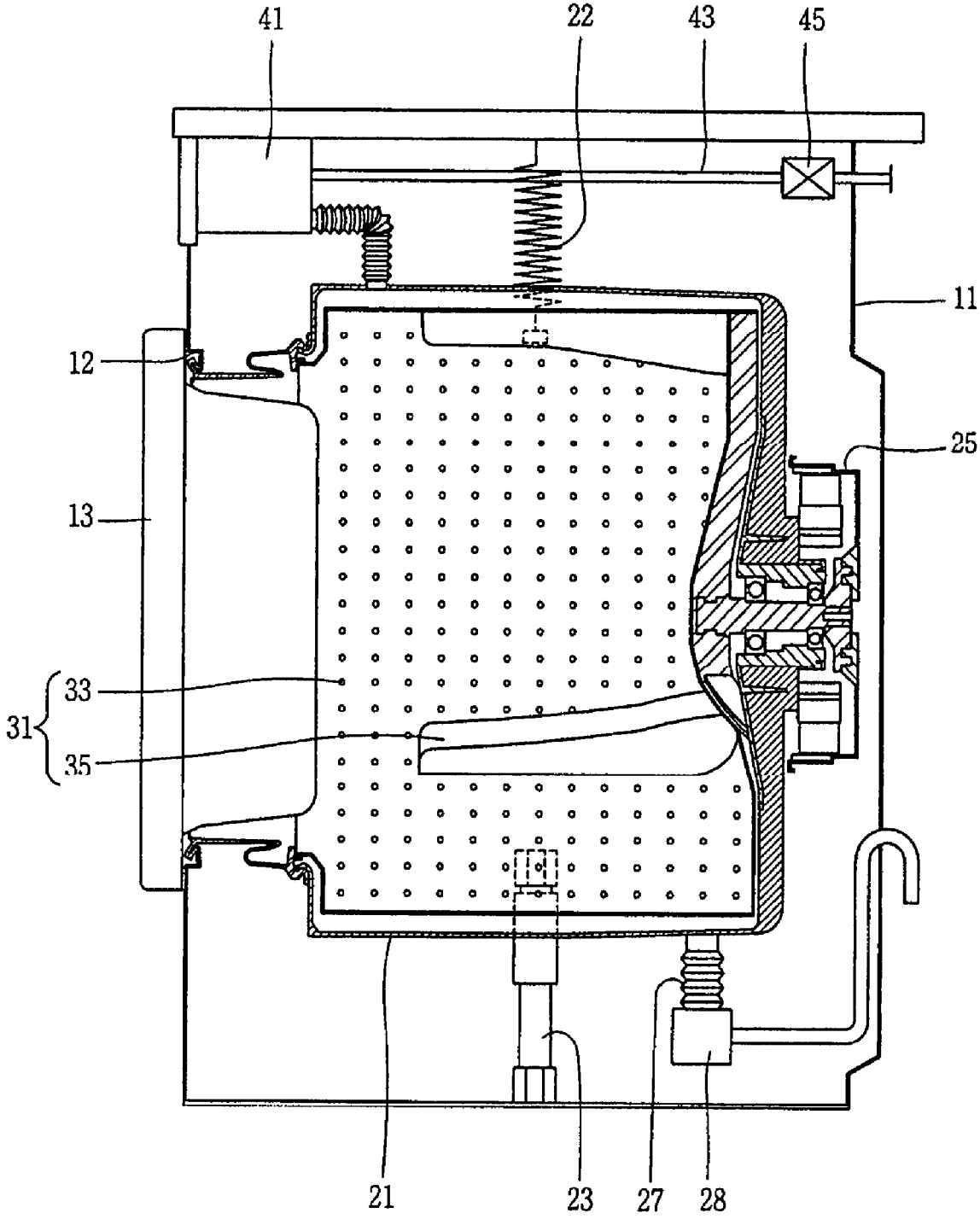
FIG. 1 RELATED ART
FIG. 1 is a cross-sectional view of a washing machine according to the related art.
Figure 2:
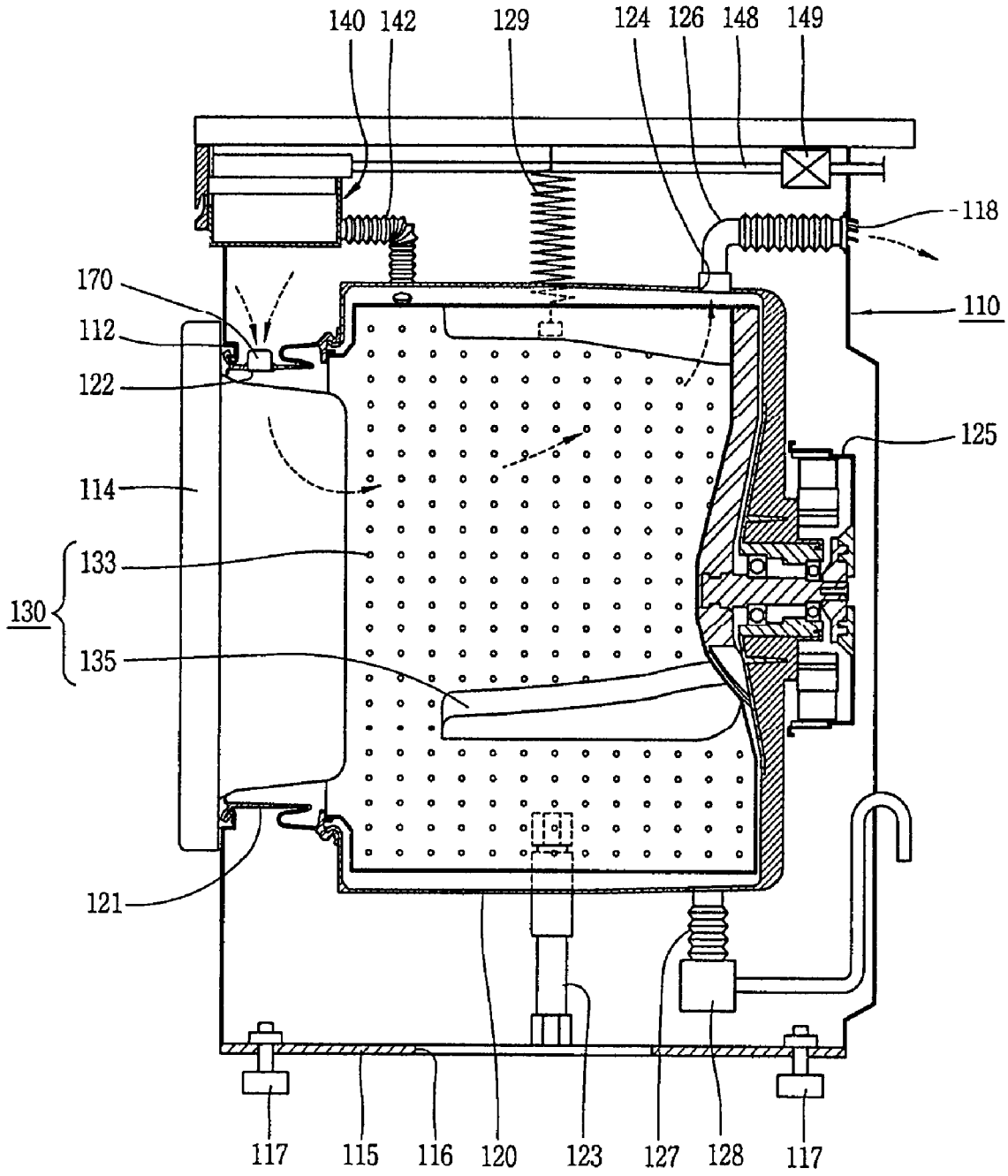
FIG. 2 is a cross-sectional view of a washing machine with an odor removal function according to a first embodiment of the present invention.

As shown in FIG. 2, a washing machine with an odor removal function according to a first embodiment of the present invention includes a cabinet 110, a tub 120 in the cabinet 110 and includes an intake port 122 and an exhaust port 124 so as to suck and discharge air, and a washing tub 130 that is rotatably provided in the tub 120.

An opening 112 and a door 114 are formed at a front surface of the cabinet 110 such that laundry can be put in and taken out of the washing tub 130. A base plate 115 is formed at a lower part of the cabinet 110, and an open portion 116 is in the plate surface and is formed at a central portion of the base plate 115. A plurality of legs 117 are engaged to the corners of the base plate 115 so as to control the height. In the cabinet 110, the tub 120 is supported by a spring 129 and a damper 123.

The tub 120 has a cylindrical shape with a front surface thereof open. A drain path 127 that includes a drain pump 128 is connected to the bottom of the tub 120 so as to drain water.

The washing tub 130 has a cylindrical shape with a front side thereof open. A plurality of through holes 133 are formed on a circumferential surface of the washing tub 130 such that the inside and the outside communicate with each other. A plurality of lifts 135 are provided on an inner surface of the washing tub 130 so as to lift the laundry. The lifts 135 protrude from the inner surface of the washing tub 130, extend in an axial direction, and are disposed separate from each other along a circumferential direction.

A detergent dispenser 140 is provided above the tub 120 so as to dispense detergent. A connecting pipe 142 has one end connected to the tub 120 and the other end connected to the detergent dispenser 140 such that the detergent is injected into the tub 120. A water supply pipe 148 is connected to an upper part of the detergent dispenser 140, and a water supply valve 149 is provided on the water supply pipe 148.

Meanwhile, the exhaust port 124 is formed on an upper portion of a rear side portion of the tub 120. An exhaust pipe 126 has one end connected to an exhaust hole 118 so as to communicate with the side of the cabinet 110, and the other end connected to the exhaust port 124. A driving motor 125 is coupled to a rear end portion of the tub 120 so as to rotate the washing tub 130. A gasket 121 formed of a resilient member is connected to the front surface of the tub 120 such that the tub 120 and the cabinet 110 are connected to each other. The intake port 122 is formed on an upper part of the gasket 121 such that air, that is, air inside the cabinet 110 is sucked into the tub 120. A foam outflow preventing unit 170 is provided on the intake port 122 so as to prevent foam inside the tub 120 from flowing out of the tub 120.

Figure 3:
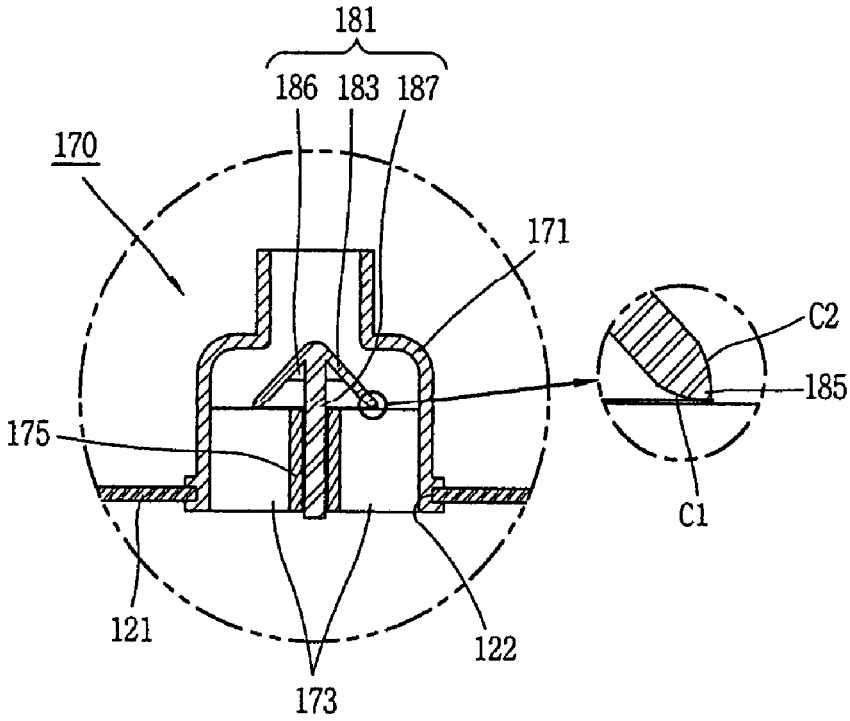
FIG. 3 is an enlarged view of a main part of FIG. 2.

As shown in FIG. 3, the foam outflow preventing unit 170 provided on the intake port 122 includes a housing 171 that has a flow passage therein, and a valve member 181 that is disposed in the housing 171 and moves relative to the housing 171 so as to open or close the flow passage of the housing 171. The housing 171 has a cylindrical shape. A guide portion 175 is formed in the housing 171 and guides the movement of the valve member 181. The guide portion 175 is supported by a plurality of supporting ribs 173 that are disposed to have a cross shape in a plane projection.

Figure 4:
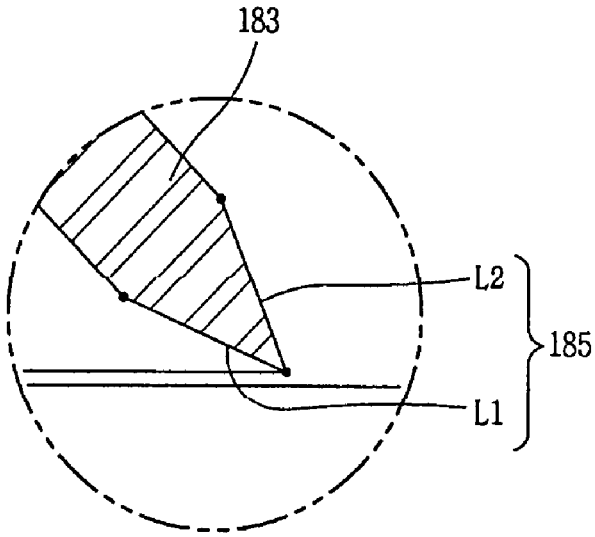
FIG. 4 is a cross-sectional view illustrating a modification of an edge portion of FIG. 3.

The valve member 181 includes a body 183 that has a cross section, in which a central portion thereof protrudes upstream against the direction of the air that flows into the tub 120, and a rod 187 that protrudes downwards from the center of a lower part of the body 183. A plurality of reinforcement ribs 186 are formed on the lower part of the body 183 and are radially disposed. The body 183 includes an edge portion 185 whose thickness gradually decreases toward the end thereof. The edge portion 185 has a cross section in which a curve C1 meets a curve C2. The curve C1 is curved downwards so as to guide the foam, which flows out of the tub 120, into the inside and facilitate the rising of the foam. The curve C2 is curved upwards so as to reduce the flow resistance of the air being sucked. As shown in FIG. 4, the edge portion 185 may have two straight lines L1 and L2 that are disposed inclined to each other so as to reduce the thickness. Further, the edge portion 185 may have any one of the two curves C1 and C2.

Figure 5:
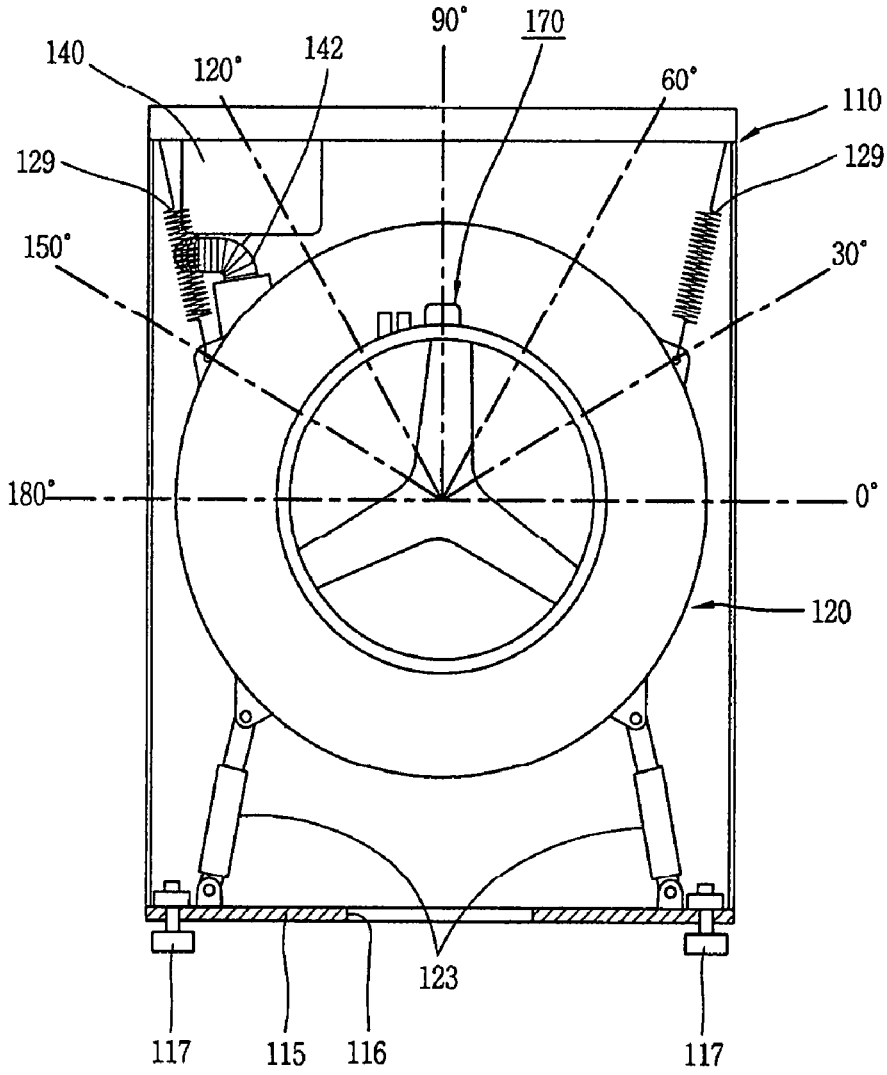
FIG. 5 is a front sectional view of a region of an air port of FIG. 2.
Figure 6:
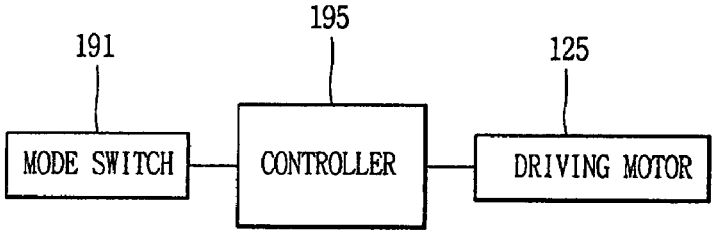
FIG. 6 is a control block diagram of a washing machine of FIG. 2.

As shown in FIG. 5, for the smooth operation of the valve member 181 of the foam outflow preventing unit 170, it is preferable that the intake port 122 be disposed around 90 degrees with respect to a horizontal direction. The intake port 122 may be provided at 30 to 150 degrees with respect to the horizontal direction.

Meanwhile, a mode switch 191 is provided outside the cabinet 110 so as to select an odor removal mode in which the odor of the laundry received in the washing tub 130 is removed. The mode switch 191 is connected to a controller 195 that controls a process in which when the odor removal mode is selected, ambient air is sucked and discharged to the outside together with an odor substance. The controller 195 is implemented in the form of a microprocessor that includes a control program. The controller 195 is connected to and controls the driving motor 125 such that the washing tub 130 may rotate with a driving pattern such as a set rotation velocity and a set direction.

According to the above-described structure, in order to remove the odor of the laundry, the door 114 is opened and the laundry is put into the washing tub 130. Then, when the mode switch 191 is used to select the odor removal mode, the controller 195 controls the driving motor 125 such that the washing tub 130 rotates at a set velocity.

When the washing tub 130 starts the rotation, air inside the washing tub 130 is exhausted to the outside of the washing tub 130 by the centrifugal force through the through holes 133. Then, air outside the tub 120 is drawn into the washing tub 130 through the intake port 122. At this time, because the valve member 181 of the foam outflow preventing unit 170 opens the flow passage of the housing 171 due to the weight of the valve member 181, air outside the tub 120 flows through the housing 171. Air outside the cabinet 110 flows into the cabinet 110 through the open portion 116 and the like. The air flowing into the housing 171 flows into the washing tub 130 by pressure difference, comes in contact with the laundry, and is exhausted to the outside of the washing tub 130 together with the odor substance of the laundry. The air outside the washing tub 130 is exhausted outside the cabinet 110 through the exhaust port 124 and the exhaust pipe 126. Meanwhile, when foam generated during the washing operation using detergent outflows through the intake port 122, the valve member 181 moves upward due to the foam and blocks the flow passage of the housing 171, thereby preventing the outflow of the foam.

Figure 7:
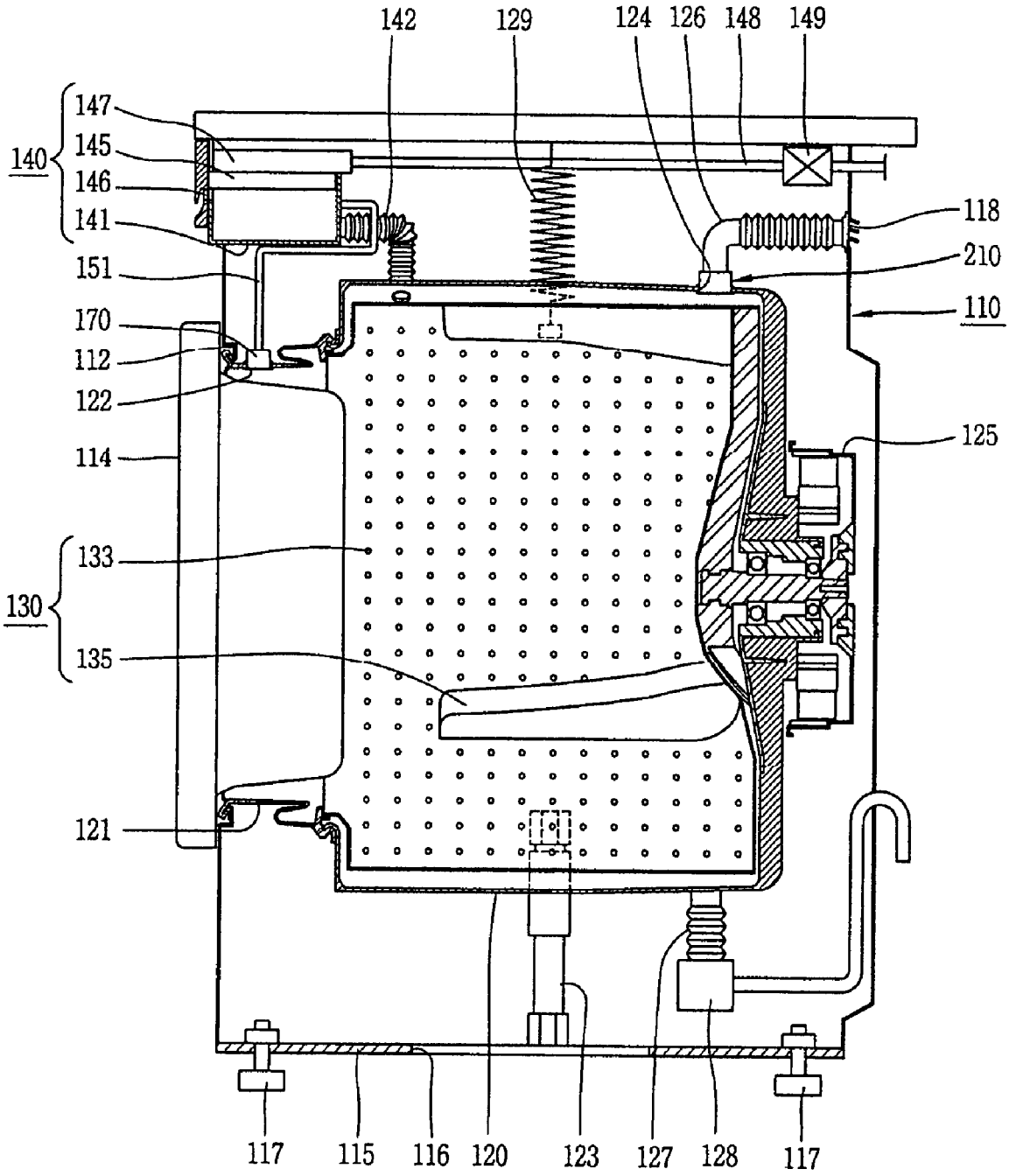
FIG. 7 is a cross-sectional view of a washing machine with an odor removal function according to a second embodiment of the present invention.
Figure 8:
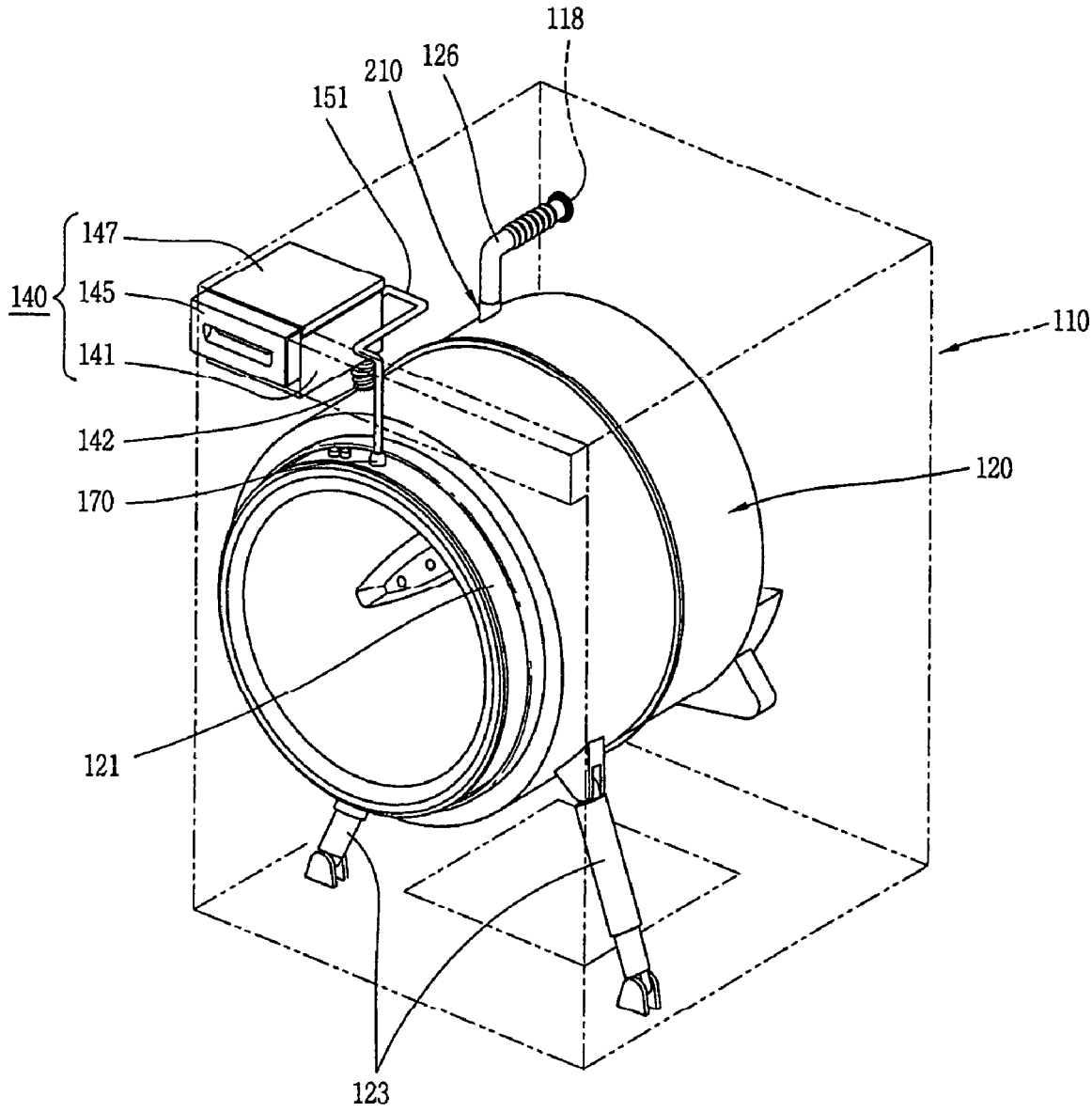
FIG. 8 is a perspective view illustrating the installation of an intake pipe of FIG. 7.

Hereinafter, a washing machine with an odor removal function according to a second embodiment of the present invention will be described with reference to FIGS. 7 to 11. Like reference numerals designate like or corresponding parts to those of the above-described or illustrated structure. Thus, the detailed description thereof will be omitted. As shown in FIGS. 7 and 8, the washing machine with an odor removal function according to the second embodiment of the present invention includes a cabinet 110, a tub 120 that is received in the cabinet 110 and includes an intake port 122 and an exhaust port 124 so as to receive and discharge air, and a washing tub 130 that is rotatably provided in the tub 120.

An opening 112 and a door 114 are formed at a front surface of the cabinet 110. In the cabinet 110, the tub 120 is supported by a spring 129 and a damper 123. A drain path 127 that includes a drain pump 128 is connected to the bottom of the tub 120. A driving motor 125 is coupled to a rear end portion of the tub 120 so as to rotate the washing tub 130. A plurality of through holes 133 and lifts 135 are provided in the washing tub 130.

The exhaust port 124 is formed on a rear upper portion of the tub 120. An exhaust pipe 126 has one end connected to the cabinet 110 so as to communicate with the outside and the other end connected to the exhaust port 124. A gasket 121 is formed at the front surface of the tub 120, and the intake port 122 is formed at an upper part of the gasket 121 so as to suck air. Foam outflow preventing units 170 and 210 are provided on the intake port 122 and the exhaust port 124, respectively, so as to prevent foam inside the tub 120 from flowing out of the tub 120. As shown in FIG. 3, the foam outflow preventing unit 170 provided on the intake port 122 includes a housing 171 that has a flow passage therein, and a valve member 181 that is disposed in the housing 171 and opens or closes the flow passage.

Figure 9:
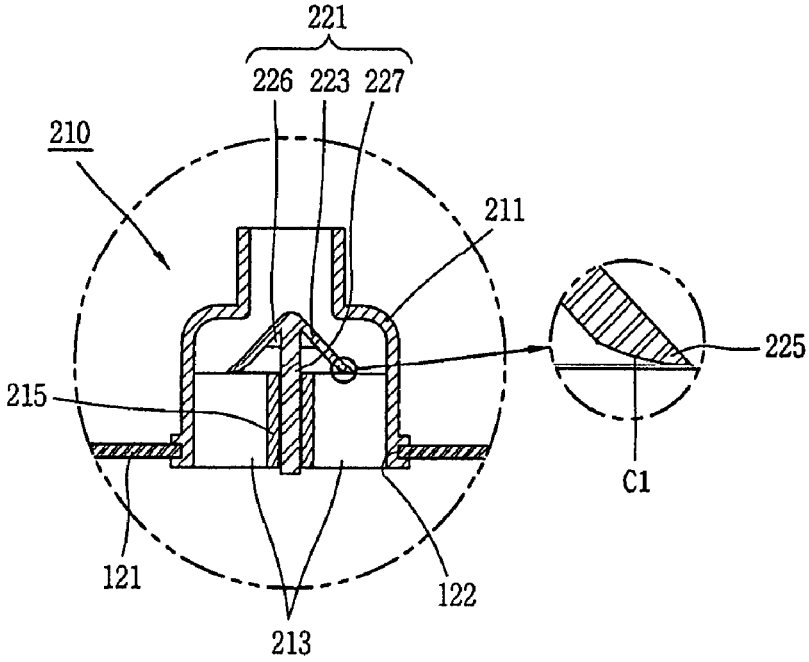
FIG. 9 is a cross-sectional view of a foam outflow preventing unit of FIG. 7.

As shown in FIG. 9, the foam outflow preventing unit 210 disposed on the exhaust port 124 includes a housing 211 that has a flow passage therein and a valve member 221 that is disposed in the housing 211 and performs relative motion to the housing 211 so as to open or close the flow passage of the housing 211. A guide portion 215 is formed in the housing 211 and guides the movement of the valve member 211. The guide portion 215 is supported by a plurality of supporting ribs 213.

The valve member 221 includes a body 223 that has a cross section, in which a central region thereof protrudes upstream the flow of air and a rod 227 that protrudes downwards from the body 223. A plurality of reinforcement ribs 226 are formed on the lower part of the body 223 and are radially disposed. The body 223 includes an edge portion 225 that has a cross section, in which the thickness of the edge portion 225 gradually decreases toward the end thereof. The edge portion 225 has a cross section in which a curve C1 is curved downwards so as to guide the foam, which flows out of the tub 120, into the inside and facilitate the rising of the foam.

Figure 10:
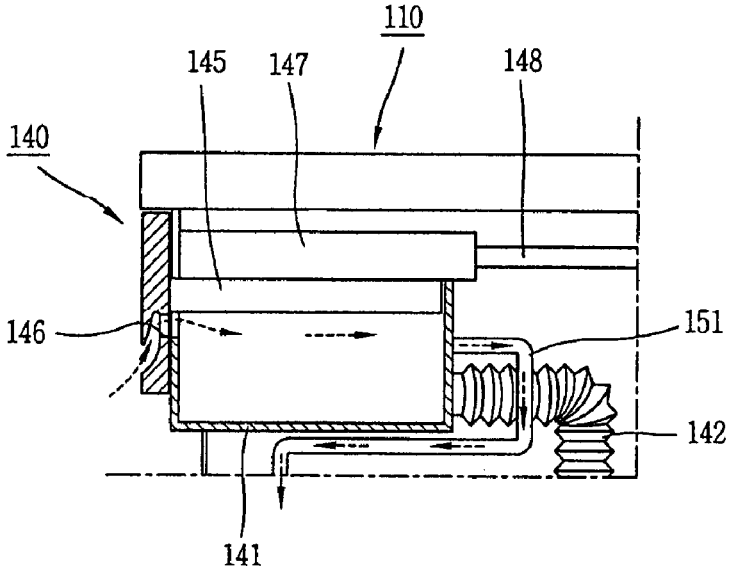
FIG. 10 is an enlarged view of a main part of FIG. 7.

Meanwhile, a detergent dispenser 140 is provided at a front upper side of the tub 120 so as to dispense detergent. As shown in FIG. 10, the detergent dispenser 140 includes a case 141 that has an accommodating space therein, a tray 145 that is received in the case 141 and can be drawn out of the case 141, and a dispenser 147 disposed above the tray 145 supplies water. An air intake hole 146 is formed on the tray 145 and communicates with the inside of the housing 171. A water supply pipe 148 is connected to the dispenser 147. A water supply valve 149 is provided on the water supply pipe 148.

A connecting pipe 142 that is composed of a corrugated pipe has one end connected to the tub 120 and the other end connected to a rear end portion of the case 141. An intake pipe 151 separated from the connecting pipe 142 has one end connected to the housing 171 of the foam outflow preventing unit 170 and the other end connected to the case 141.

According to the above-described structure, in order to remove the odor from the laundry, the target laundry is put in the washing tub 130, and the mode switch 191 is manipulated to select the odor removal mode. When the mode switch 191 is manipulated to select the odor removal mode, the controller 195 controls the driving motor 125 such that the washing tub 130 rotates at a set velocity and in a set direction. When the washing tub 130 rotates, air inside the washing tub 130 is exhausted outside the washing tub 130 together with the odor of the laundry through the through holes 133, and then the air and the odor substance are exhausted to the outside through the exhaust port 124 and the exhaust pipe 126.

Figure 11:
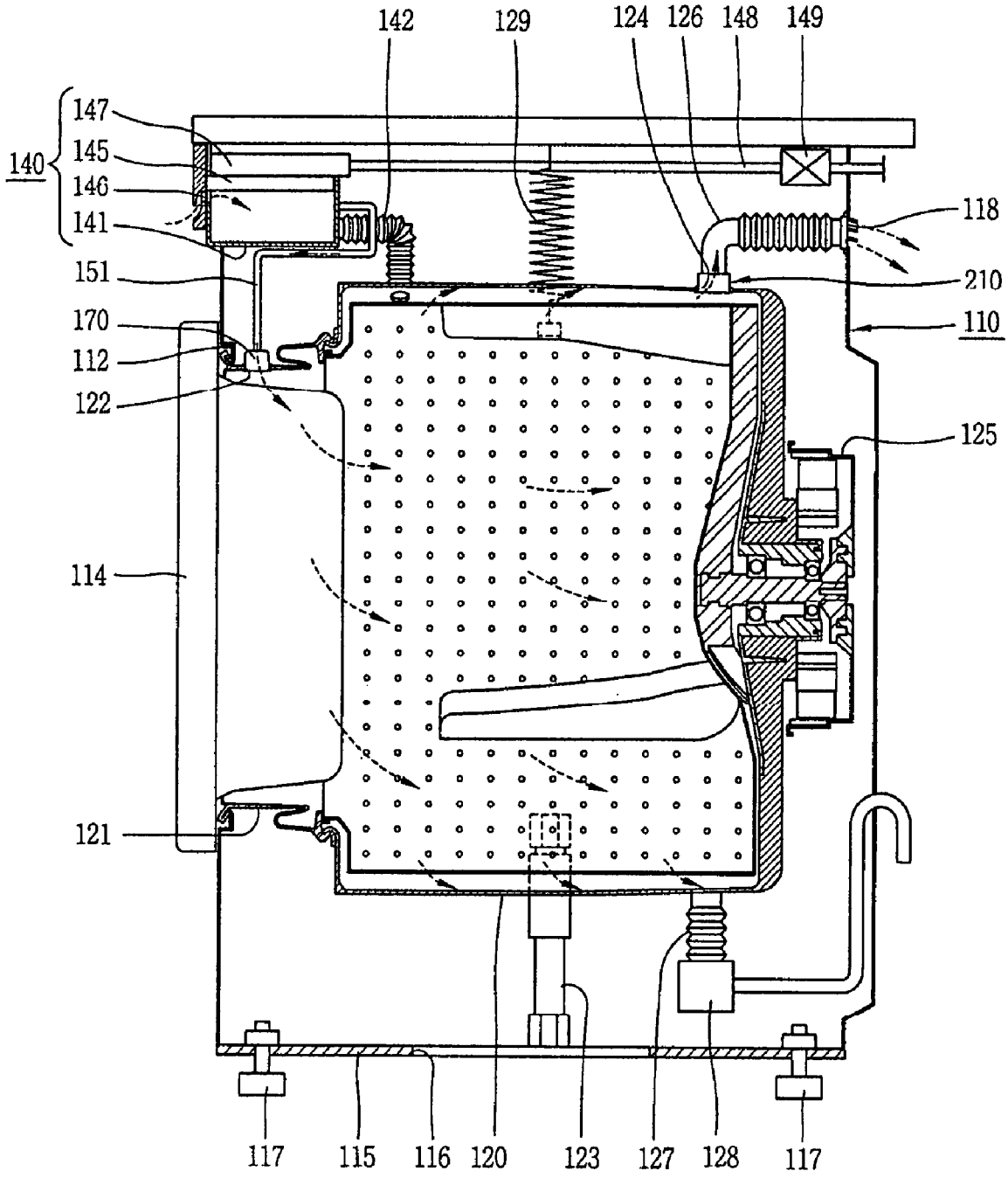
FIG. 11 is view illustrating an air flow of FIG. 7.

More specifically, the valve members 181 and 221 of the foam outflow preventing units 170 and 210 that are formed on the intake port 122 and the exhaust port 124, respectively, open the flow passages of the housings 171 and 211, respectively. Therefore, as shown in FIG. 11, when a suction force is generated by the rotation of the washing tub 130, air outside the cabinet 110 is sucked into the case 141 through the air intake hole 146 of the tray 145. The air sucked into the case 141 flows along the intake pipe 151 and flows into the washing tub 130 through the foam outflow preventing unit 170 and the intake port 122. The air flowing into the washing tub 130 is exhausted to the outside of the washing tub 130 together with the odor of the laundry through the through holes 133, and then the air and the odor are discharged to the outside of the cabinet 110 through the exhaust port 124, the foam outflow preventing unit 210, and the exhaust pipe 126. These processes are repeatedly performed so as to perform the odor removal function on the laundry.

Hereinafter, the operational effect of the washing machine with an odor removal function according to the embodiments of the present invention will be described as follows.

According to the embodiments of the present invention, there is provided the washing machine with an odor removal function capable of removing the odor from the laundry more easily and quickly by flowing air from outside the tub into the tub by the rotation of the washing tub and discharging the air to the outside together with the odor substance of the laundry.

Further, according to the embodiments of the present invention, it is possible to reduce water and power consumption because a washing operation using water for deodorization of the laundry is not needed and to prevent damage to the laundry and the shortening of the laundry life that are caused by the increased washing time using the water.

Further, according to the embodiments of the present invention, the effect of easily and quickly removing the odor of the laundry can be offered without making a large change in the structure of the washing tub nor installing expensive equipment.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A washing machine with an odor removal function, comprising:

a cabinet having an exhaust hole;

a tub in the cabinet and including an exhaust port for discharging air inside the tub;

a gasket sealingly connecting the cabinet and the tub and including an intake port for sucking air into the tub;

an exhaust pipe having an end connected to the exhaust port and the other end connected to the exhaust hole of the cabinet so as to discharge air inside the tub;

a washing tub rotatably provided in the tub;

a connecting pipe that communicates with a detergent dispenser to dispense detergent to the washing tub; and an intake pipe having one end connected to the intake port and the other end communicating with the outside of the cabinet separately from the connecting pipe and is directly connected to the detergent dispenser to communicate with the outside of the cabinet, the intake pipe configured to provide air substantially to the washing tub, wherein air inside the cabinet flows into the tub through the intake port by a suction force generated when the washing tub rotates and air inside the washing tub flows to the outside of the cabinet, such that laundry odor is removed and wherein the intake port is closer to the center of the tub in a radial direction than the exhaust port to make a pressure difference between the intake and exhaust port and cause the air to flow.

2. The washing machine with an odor removal function of claim 1, further comprising:

a mode switch selecting an odor removal mode in which the odor of the laundry received in the washing tub is removed; and a controller controlling a driving motor of the washing tub such that the washing tub rotates when the odor removal mode is selected by the mode switch.

3. The washing machine with an odor removal function of claim 1, wherein the detergent dispenser communicating with the outside is provided in the cabinet, and the other side of the intake pipe is connected to the detergent dispenser.

4. The washing machine with an odor removal function of claim 3, wherein the detergent dispenser includes a case that is fixed to the cabinet, and a tray that is in the case and can be drawn out of the case, and has an air intake hole communicating with the outside, and the intake pipe is connected to the case.

5. The washing machine with an odor removal function of claim 2, wherein the intake port is formed at a front surface of the tub, and the exhaust port is on an upper portion of a rear portion of the tub.

6. The washing machine with an odor removal function of claim 2, further comprising:

a foam outflow preventing unit provided on the intake port that prevents foam inside the tub from flowing to the outside.

7. The washing machine with an odor removal function of claim 6, wherein the foam outflow preventing unit includes a housing that has a flow passage therein and a valve member that is provided in the housing so as to open or close the flow passage.

8. The washing machine with an odor removal function of claim 7, wherein the valve member has a central portion that protrudes upstream against the flow direction of sucked air.

9. The washing machine with an odor removal function of claim 8, wherein the valve member includes an edge portion whose thickness gradually decreases toward the end thereof

10. The washing machine with an odor removal function of claim 2, further comprising:

a foam outflow preventing unit provided on the exhaust port and preventing foam inside the tub from flowing to the outside.

11. The washing machine with an odor removal function of claim 10, wherein the foam outflow preventing unit includes a housing that has a flow passage therein, and a valve member that is provided in the housing so as to open or close the flow passage.

12. The washing machine with an odor removal function of claim 11, wherein the valve member has a cross section in which a central portion thereof protrudes downstream along a direction in which the air is exhausted.

13. The washing machine with an odor removal function of claim 12, wherein the valve member includes an edge portion that has a thickness gradually decreasing toward the end thereof, the edge portion having a cross section with a bottom line convexed downwardly.

14. The washing machine with an odor removal function of claim 2, wherein a gasket is formed on a front surface of the tub, and the intake port is formed on the gasket.

* * * * *